United States Patent [19]

Yingst et al.

[11] Patent Number: 4,774,814

[45] Date of Patent: Oct. 4, 1988

[54] ICE MAKING MACHINE

[75] Inventors: Thomas E. Yingst, Aurora, Colo.; Frederick A. Weis, Chattanooga, Tenn.

[73] Assignee: Mile High Equipment Company, Denver, Colo.

[21] Appl. No.: 70,661

[22] Filed: Jul. 6, 1987

Related U.S. Application Data

[63] Continuation of Ser. No. 904,188, Sep. 5, 1986, abandoned.

[51] Int. Cl.[4] ..... F25C 5/10

[52] U.S. Cl. ..... 62/126; 62/156; 62/352

[58] Field of Search ..... 62/234, 278, 81, 156, 62/352, 348, 126

[56] References Cited

U.S. PATENT DOCUMENTS

| | | | |
|---|---|---|---|
| 2,526,262 | 10/1950 | Munshower | 62/105 |
| 2,579,379 | 12/1951 | Fritsche | 62/116 |
| 2,645,910 | 7/1953 | Leeson | 62/107 |
| 2,722,110 | 11/1955 | Denzer | 62/107 |
| 2,995,905 | 8/1961 | Aynes et al. . | |
| 3,289,430 | 12/1966 | Dedricks et al. | 62/188 |
| 4,009,594 | 3/1977 | Swanson | 62/81 K |
| 4,341,087 | 7/1982 | Van Steenburgh, Jr. | 62/233 |
| 4,387,578 | 6/1983 | Paddock | 236/94 K |
| 4,489,567 | 12/1984 | Kohl | 62/138 |
| 4,573,325 | 3/1986 | Chiu et al. | 62/233 X |

FOREIGN PATENT DOCUMENTS

| | | | |
|---|---|---|---|
| 8503995 | 9/1985 | Int'l Pat. Institute | 236/94 |
| 0146349 | 12/1978 | Japan | 62/234 |

*Primary Examiner*—William E. Wayner

*Attorney, Agent, or Firm*—Hubbard, Thurman, Turner & Tucker

[57] ABSTRACT

A self-contained ice making machine includes a programmable controller connected to control operation of the machine which includes monitoring the operation of the machine for producing diagnostic type error signals for display, and issuing operating instructions to the refrigeration unit. The refrigerator unit has a condenser with cooling fans, evaporator, a water supply means, and an ice harvest probe assembly. The evaporator includes a coil, and an array of ice cube molds. The water supply means includes a water tank for flowing water over the evaporator, a pump for pumping water to the evaporator and from the tank and a solenoid controlled valve for controlling the flow of water to and from the tank. The ice harvest probe assembly includes a probe driven by a slip clutch motor for pushing against an ice cube bearing slab formed on the evaporator during ice cube harvest. The programmable controller is programmed to control the ice making operation of the unit including refrigerator initialization, sensing the end temperature of an ice cube freezing cycle for determining when ice cubes have been formed, initiating first a timed freezing cycle to bridge the ice cubes within a thin ($\frac{1}{8}$ inch) ice slab and then a harvest anticipation feature which includes turning off the condenser fans in advance of harvest for increasing the temperature of high pressure gas out of the compressor for harvest.

9 Claims, 5 Drawing Sheets

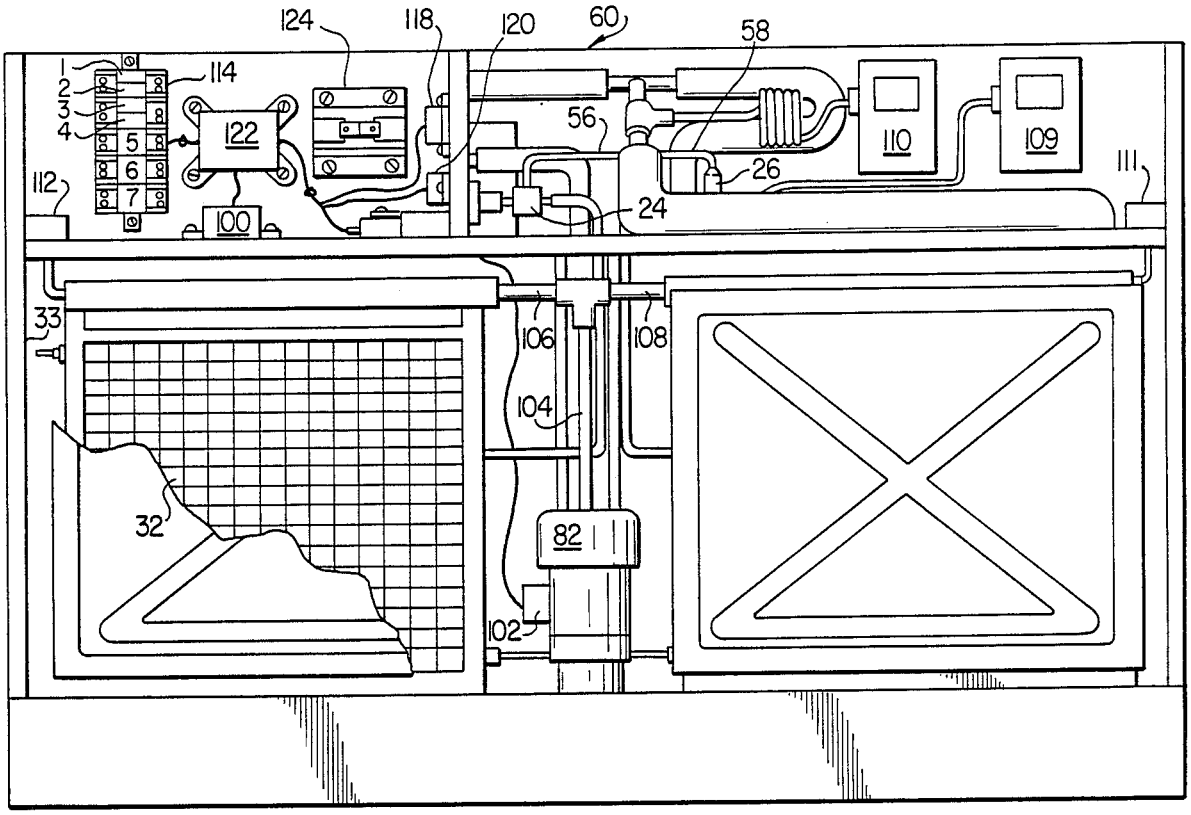
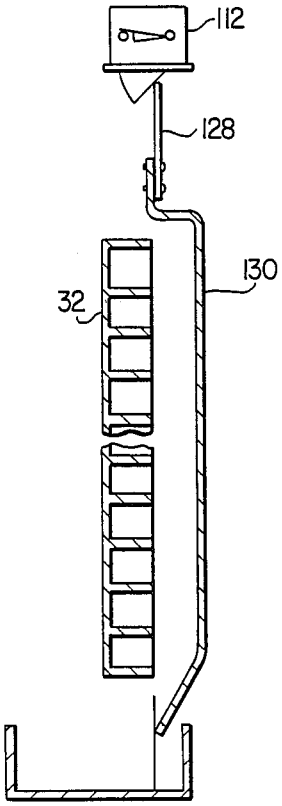
FIG. 5
FIG. 4
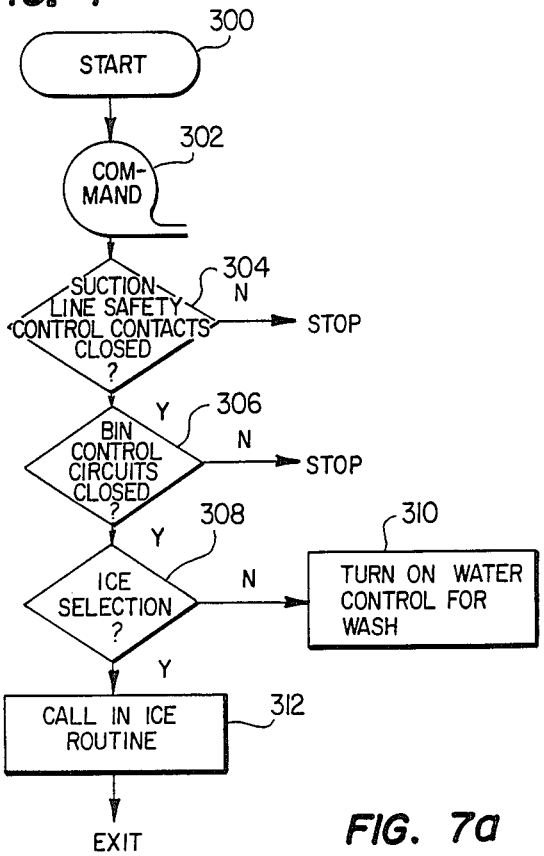
FIG. 7a

| OUTPUTS | FIRST FREEZE | TIMED FREEZE | HARVEST ANTICIPATION | HARVEST PURGE & DE-FROST | HARVEST SLAG OUT |
|---|---|---|---|---|---|
| COMPRESSOR (SOLENOID ON REMOTE) | ▬ | ▬ | ▬ | ▬ | ▬ |
| WATER PUMP | ▬ | ▬ | ▬ | ▬ | |
| FANS 1 & 2 | ▬ | ▬ | | | |
| HARVEST MTR. 1 | | | | ▬ | ▬ |
| HARVEST MTR 2 | | | | ▬ | ▬ |
| PURGE VALVE | | | | ▬ | |
| HOT GAS VALVE | | | | ▬ | |

ICE MAKING MACHINE

This application is a continuation of application Ser. No. 904,188, filed 9/5/86, now abandoned.

BACKGROUND OF THE INVENTION

This invention relates to ice making machines and more particular to an improved self-contained ice making machine.

In the past, two types of ice making machines have existed. The first type is used in connection with household refrigerators; this type is not self-contained. In general they rely upon thermostats to sense the temperature of the ice trays; at a certain temperature, an ejection motor is turned on to rotate ice cube removal arms and timing cams for controlling operation.

The second type is the self-contained ice maker used in motels, restaurants, and stores. Principally, this type freezes a slab of ice cubes held together by an ice bridge. In this type, during the freezing cycle water is continually flowed over and recirculated over an evaporator rack to freeze first the ice cubes and then the bridge. The freezing of the ice cubes is determined from the temperature of the evaporator, after which a timer controls the bridge thickness and the freezing cycle is discontinued. At this time, a defrost cycle is begun.

The defrost cycle is initiated by turning off the condenser fan and energizing a hot gas solenoid valve. Hot gas from the compressor is allowed to flow directly to the evaporator grid to melt the ice cube slab from the grid. The ice cube slab is held to the grid by the capillary action of the melted ice; a probe driven by a slip clutch type motor overcomes the capillary attraction to push the ice cube slab into an ice bin. A cam on the probe motor signals the harvest of the ice cubes to restart the freezing cycle. An electro-mechanical type controller uses sensor actuated relays to control their operation. Before the next freezing cycle begins the remaining water, that had been circulating over the freezer plate and has a high mineral content, is removed through the overflow tube from the water tank reservoir. The tank is then refilled with water by energizing a water valve solenoid. In both types of ice making machines, the operation is controlled by an electromechanical type controller using sensor actuated relays to control other relays and cams, with the last described type replacing more of the cams with more reliable electrical relays.

In principle, the ice making machine according to the invention corresponds to the known ice making machine briefly described above. The essential difference is that the electro-mechanical controller has been replaced with a programmable controller, and the operation cycle has been modified to include a harvest anticipation cycle. The advantages are that the programmable controller provides a complete diagnostic capability in addition to improved manufacturing, operation and maintenance costs; the harvest anticipation feature reduces the operation cycle time to produce more ice in a given time period.

SUMMARY OF THE INVENTION

Accordingly, it is an object of the invention to provide an improved ice making machine.

Another object of the invention is to provide an ice making machine which is fully automatic in operation, reliable, and having an operating diagnostic capability for quick an easy maintenance.

A further object of the invention is to provide a self-contained ice maker which is economical to fabricate, operate and maintain.

Still another object of the invention is to provide a self-contained ice maker having a harvest anticipation feature for increasing yield capability for any given period.

Briefly stated the ice making machine of this invention comprises a self-contained ice making machine having a plurality of sensors for producing ice making operational information, a programmable controller means responsive to the operational information for producing decision signals, and a plurality of action means responsive to the decision signals for automatically operating the ice making machine continuously. In addition, the programmable controller provides a diagnostic capability for reducing substantially operational down time; and an operating cycle which includes an harvest anticipation feature for decreasing the cycle time.

BRIEF DESCRIPTION OF THE DRAWINGS

Other objects and features of the invention will become more readily understood from the following detailed description and appended claims when read in conjunction with the accompanying drawings in which:

FIG. 4, is a front view of the ice making unit;

FIG. 5, is a partial side view of the bin switch control;

FIGS. *7a* and *7b* are flow charts of the ice making machine operation; and

Figures 7B, 8:
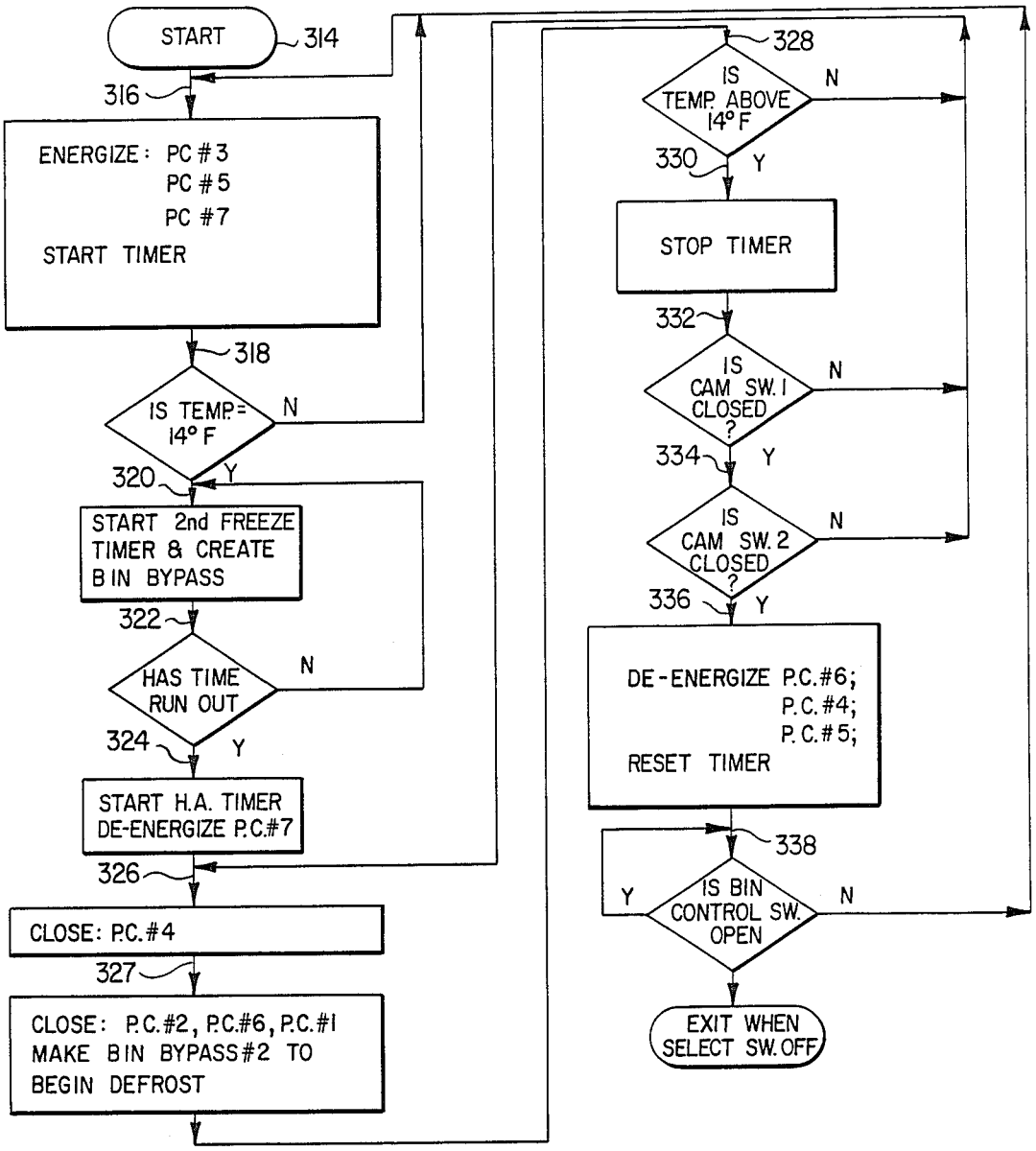

FIG. 8 is a timing chart showing the time of component operation during a complete operation cycle.

DESCRIPTION OF THE PREFERRED EMBODIMENT

Figure 1:
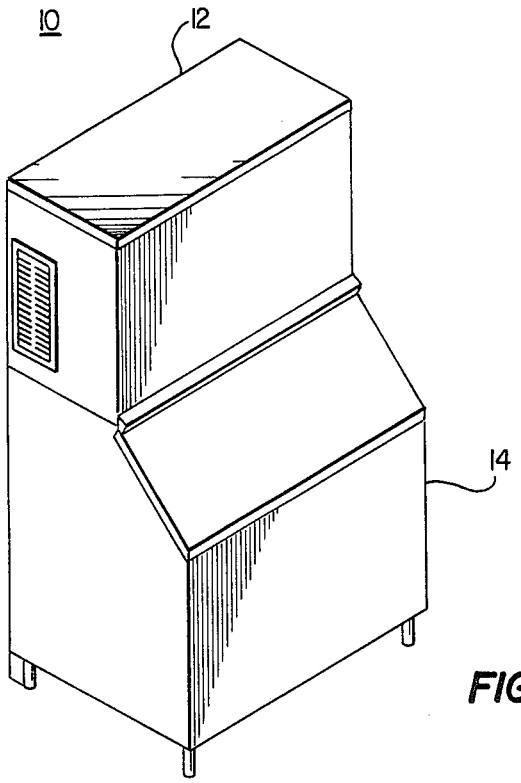
FIG. 1 is an isometric view of the ice making machine constituting the subject matter of this invention.

The ice making machine 10 (FIG. 1) includes a refrigeration unit 12 resting on top of an ice storage bin 14. The refrigeration unit 12 is in communication with the storage bin 14. When the ice is harvested it is deposited in the ice bin 14 through first and second doors, if used, as hereinafter described. For purposes of description only and not by way of limitation the description of the invention will be for a dual ice making system, although it will be appreciated that a single ice making system is envisioned as being within the scope of the invention.

REFRIGERATION SYSTEM

Figure 2:
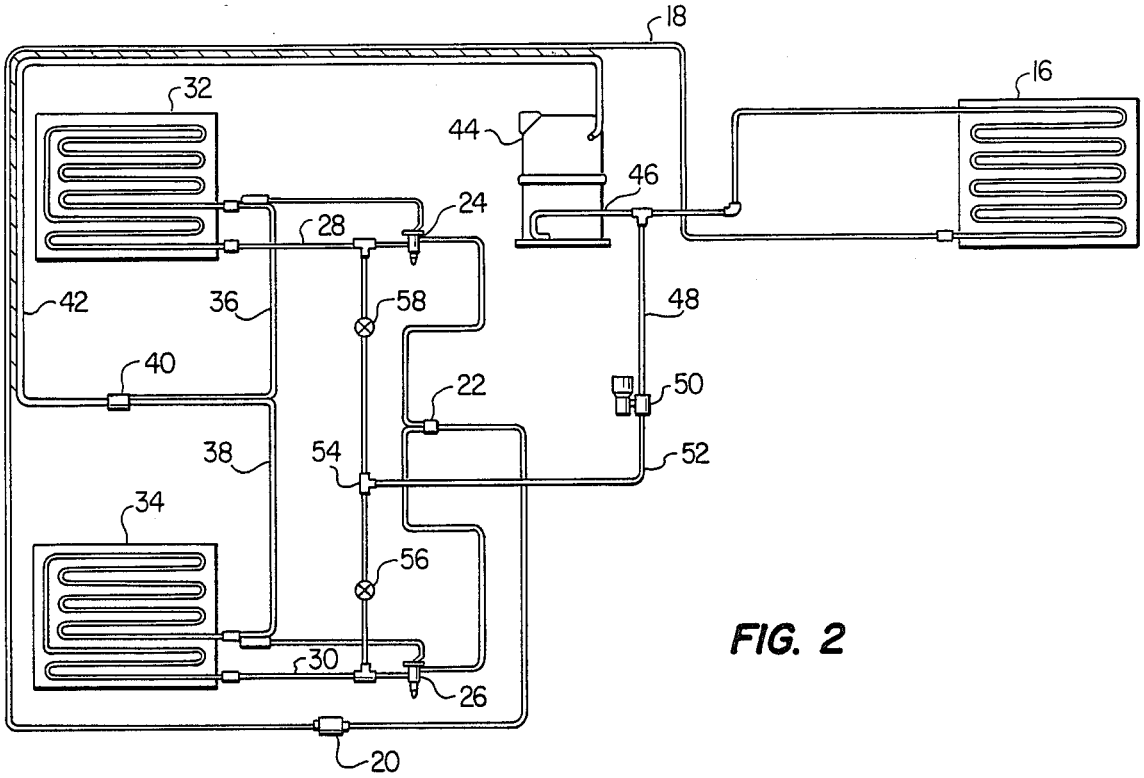
FIG. 2 is a schematic of the refrigeration system.

The refrigeration system (FIG. 2) includes a condenser 16 from which high pressure liquid flows through conduit 18, in line drier 20, and divider 22 to expansion valves 24 and 26. The expansion valves 24 and 26 convert the high pressure liquid to low pressure liquid. The low pressure liquid passes from the expansion valves 24 and 26 through pipes 28 and 30 to first and second evaporators 32 and 34, respectively for cooling the evaporators to ice making temperatures.

In the evaporators the low pressure liquid absorbs heat, begins to boil, and evaporates as a low pressure gas. Conduits 36 and 38 conduct the low pressure gas to a combiner 40 where it is combined and passed through a suction conduit and heat exchanger to a compressor 44. The compressor 44 changes the low pressure gas to a high pressure gas which is returned through conduit 46 to the condenser 16 for conversion to a high pressure liquid.

The absorption of heat by the evaporators 32 and 34 cools evaporator plates and water passing thereover to freeze the water and produce ice. The ice is harvested by passing the hot high pressure gas from conduit 46 through conduit 48 to a high pressure gas solenoid valve 50. At the appropriate time, hereinafter described, the solenoid valve 50 is opened to pass the hot high pressure gas through conduit 52, T 54, check valves 56 and 58 and conduits 28 and 30 to evaporators 32 and 34. The hot plate heats the evaporator plates to melt the surrounding ice therefrom. The ice is removed (harvested) at the appropriate time by first and second motor driven probes as hereinafter described.

ICE MAKER ARRANGEMENT

The ice making unit 12 (FIG. 4) includes a rear housing section 59 and a front housing portion 60. The rear housing portion 59 (FIG. 3) houses the condenser 16. The condenser 16 is either water cooled by coils 62 or by first and second fans 64 driven by fan motors 66 and 68 (FIG. 5), for clarity only one fan 64 (FIG. 2) is shown mounted in the side of housing 59. Conduit 18 passes through the partition 70 to interconnect the condenser to the evaporators 32 and 34 on the other side. A water regulator valve 72 controls the flow of water through line 74 to the condenser. A thermistor 75 is attached to the condenser for monitoring continuously the temperature of the condenser.

Figure 3:
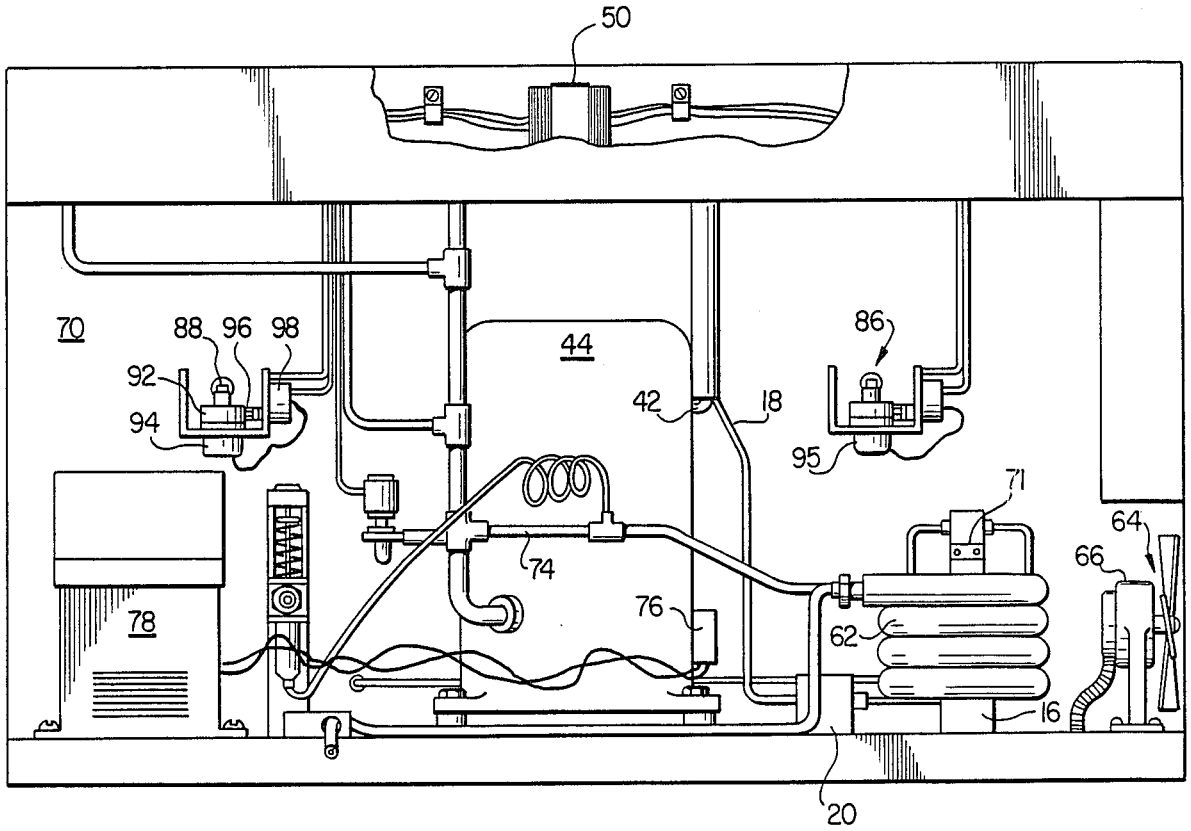
FIG. 3 is a rear view of the ice making unit.

The compressor 44 is connected by line 46 to the evaporators 32 and 34 and by line 48 to the hot gas valve 50. The compressor is electrically connected to the coil of the hot gas valve and to a starting relay, starting capacitor, and running capacitor 76; these in turn are connected to the potential relay 78. A water purge valve 80 for purging water from the water tank 82 (FIG. 4) is attached to partition 70 (FIG. 3). Two ice probe subsystems 84 and 86 are attached to partition 70 to complete the rear compartment arrangement. The ice probe subsystems 84 and 86 each include a probe member 88 which extends through partition 70, and coils and plate of evaporator 32 (FIG. 4) to the evaporator grid harvest rack 90. The probe member 88 (FIG. 4) is pivotally attached to a rotating arm 92 for reciprocating movement therewith. A slip clutch type motor 94 is connected to drive the rotating arm 92. The rotating arm 92 base forms a cam 96 for engaging a cam switch 98. Cam switch 98 is connected to control the setting of a timer 100 (FIG. 4). The clutch motor is used to drive the probe member against an ice cube bearing slab formed on the grid harvest rack 90 of the evaporator during the harvest cycle. The clutch permits drive arm slippage to allow time for the hot evaporator to loosen the ice slab. When the ice slab is loosened, the motor driven probe overcomes the capillary force to remove the ice from the slab into the bin. The total movement of the probe driving arm is one revolution; therefore the driving arm cam is positioned with respect to the driving arm to engage the cam switch at the end of the revolution to reset the timer for another freezing cycle. This ensures the proper operation of the unit.

The front housing portion 60 (FIG. 4) houses the evaporators 32 and 34 in a first compartment. The water tank 82, and a water pump are positioned between the evaporators. The water tank is connected by line 104 to two water distributor tubes 106 and 108 for the evaporators 32 and 34. More specifically, each evaporator includes copper tubing, soldered to a copper plate, which is assembled together with a series of copper strips to form a grid configuration. The evaporator allows freezing from 5 sides at a time per cube. Water return troughs 126 (FIG. 5) are positioned beneath the evaporators for collecting and returning the ice making water as it leaves the evaporators.

A second compartment located above the evaporators houses high pressure and low pressure controls 109 and 110, the check and expansion valves 56 and 58, and 24 and 26, and a bin control switch 111. While, a system controller compartment located above the evaporator compartment and adjacent to the second compartment includes a bin control switch 112, a plurality of relays 114, timer 100, fan control switch 116, purge switch 118, and On/Off/Wash switch 120 all connected to the programmable controller 122. A contactor switch 124 is connected to the relays 114 as hereinafter described to complete the elements in the system controller compartment. Each relay of the relays 114 is replaced by, for example, an opto isolated triac driver connected to a computer latch terminal and a triac as its principal components. The bin may be provided with switch operated doors (not shown) located beneath the evaporators. During harvest the doors are opened and closed automatically for admitting the ice cubes into the bin.

The bin control switches 111 and 112 each form a part of bin control subsystems (FIG. 5). As the bin control subsystems are identical only one need be described. The bin control switch 112 is toggled by a switch activating pin 128. A splash curtain 130 is pivotally connected to pivot with the splash curtain. The splat curtain pivots in front of the evaporator harvest rack and has a bottom edge which extends inwardly over the water return when the bin switch is in the on position. Ice from a full bin pivots the splash curtain outwardly to drive the switch pin inwardly to toggle the switch off. The switch is normally closed to power the machine on when the splash curtain returns to just beyond the outer edge of the water return trough. If doors are used, the bin control switches become the door switches; the door switches are controlled by bin thermostats to sense a full bin and the doors are controlled by the programmable computer in the same manner.

PROGRAMMABLE CONTROLLER

The controller is microcomputer based, designed to operate multiple configurations of commercial ice making machines. It controls the motors, fans, compressor, solenoid valves, and pumps previously described for ice making. The control decisions are based on the temperature sensors, switches, time, and control program, hereinafter described.

The controller monitors and stores the operational data including the number of harvest cycles and accumulated error codes since the last reset.

Thus, the controller interfaces with the existing switching and control devices, and has several built-in self diagnostic capabilities, which operate continuously. When errors are detected, in either its' own operation or in the ice making machine, an error code description as well as the number of occurrences of that error are stored in memory until the problem is serviced and the controller reset.

Figure 6:
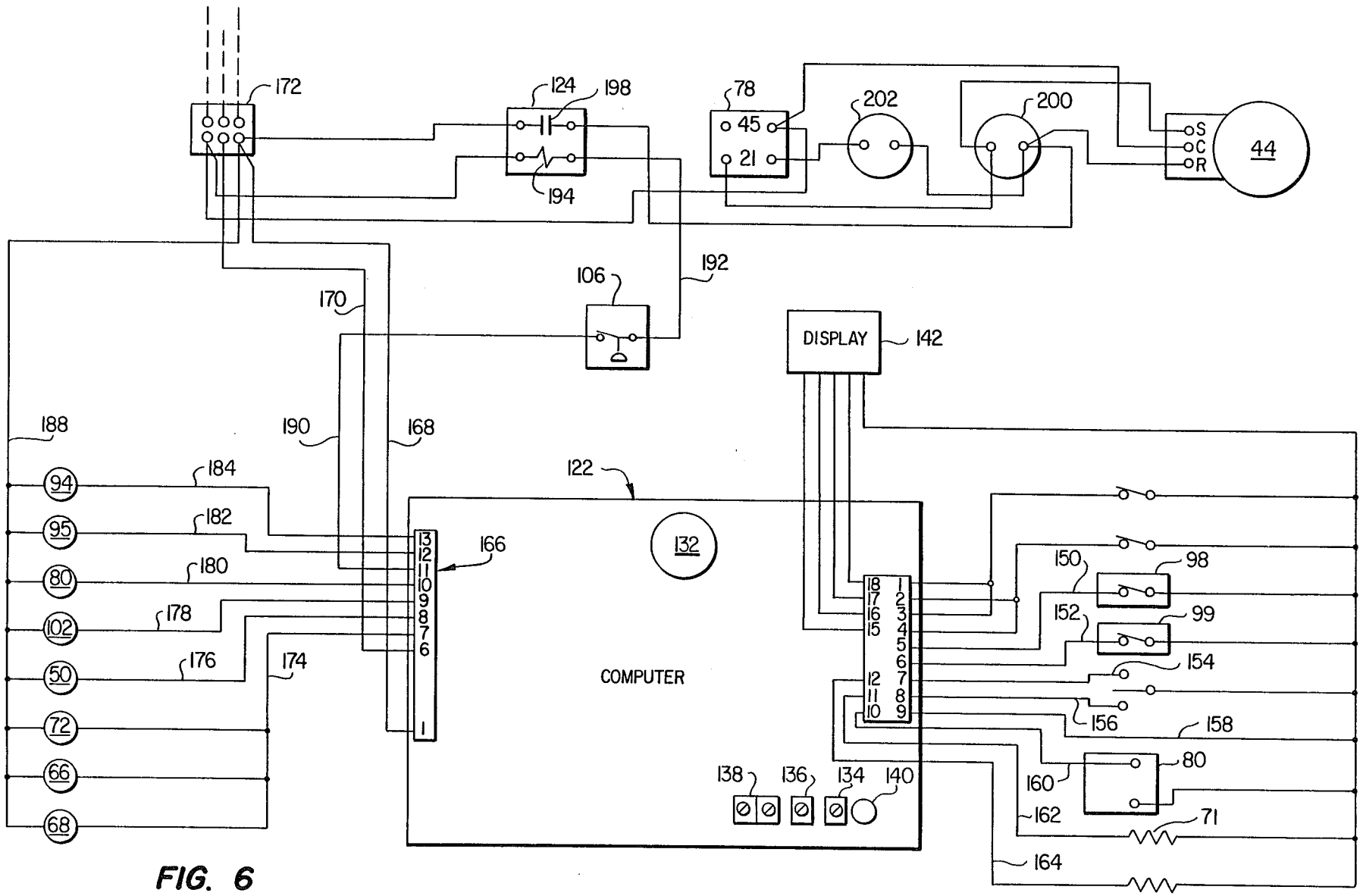
FIG. 6 is a schematic view partly in block form showing the functional embodiment of the overall invention.

The programmable controller 122 (FIG. 6) includes, as a data processing means, a solid state computing means which may be, for example, a CMOS microcomputer IC 6303RP sold by Hitachi Company. The microcomputer includes an electrically programmable read only memory and a random access memory, a crystal clock, connected to the clock terminal, a lithium battery connected to Vcc, a display, sensor connector circuits, and power connector circuits. The read only memory contains the control instructions and the random access memory stores the systems configuration parameters, operating data, error code logs, and operational history. The crystal clock and the lithium battery can be omitted if a clocking accuracy of +2% and/or the loss of the accumulated number of error codes and harvests due to power failure is acceptable. It will be appreciated that the make up of the computing means depends upon the basic computing means which could include all the above components on a single semiconductor chip.

Thus, the programmable controller 122 is connected to a power source 132, which may include, for example, a back-up power source such as, for example, a lithium battery. The computer includes: four indicator lights 133 to show the running condition of the ice machine, for example, green lights are used to indicate making ice or bin full, yellow for harvest, and red for call the serviceman. The computer also includes operation information input means, which includes: a cycles per purge input means 134 for inputting the number operating cycles to be counted before purging the water system; a time setting means 136 for setting the time period for the time freeze cycle; a time setting means 138 for setting the time period for harvest anticipation. An operation reset switch 140 is provided for hand stepping the controller through its operating functions including a maintenance and repair diagnostic routine and memory reset.

The cycles per purge setter 134 includes a thumbwheel type number rotary switch which may be rotated between 0 and 9 to set the number of freezing cycles to be performed before draining the water tank to purge it of mineral accumulation. The selected number is displayed on the display. It will be appreciated that during the freezing process while the water is run over the evaporators the ice forming process rejects the minerals contained in the water. These minerals accumulate in the water tank; if not removed they are deposited on the evaporator slab on the next freezing cycle and thereafter the water will freeze and form a cloudy cube and minerals will accumulate on the evaporator. Thus, for water containing bicarbonates, for example, the water tank should be purged after each freezing cycle. In areas where the water is pure, which is hard to come by, the purity of the water permits a setting of 3, 4, or 5. If the water supply system is to be purged after each cycle the cycles per purge setter feature can be omitted.

The harvest anticipation time setting means 138 is also a thumbwheel type rotary switch which is adjustable from 0 to 90 seconds in 10 second increments. To properly set the harvest anticipator, the time should be increased until the condenser exceeds 117 degrees Fahrenheit and begins to cycle. The time is then reduced 10 seconds so that the condenser does not cycle. It is always preferable to set the anticipation time setting means at a slightly lower setting to ensure that the condenser does not cycle. The harvest anticipator turns off the fan motor or water inlet valve for water cooled condenser prior to the end of the timed freeze cycle which is controlled by a timer. This action will raise the condensing temperature prior to the start of the harvest cycle and allows for hotter gasses to be available to enter the evaporator when the hot gas solenoid opens at the start of the harvest cycle.

The freeze time setting means 138 is adjustable between 0 and 990 seconds. Two rotary switches which can be set from 0 to 9 are connected and their setting multiplied by 10 to equal the desired freezing time in seconds. Specific settings for each machine is determined at the factory, but may require field adjustment to achieve a ⅛ inch bridge over the ice cubes contained in the first and second evaporator racks.

The sensor circuits provide operational indicating signals to a liquid crystal display as follows. First and second door sensors 146 and 148 are connected, respectively, to pins 1 and 3, and 2 and 4 of the sensor connectors 142 for sensing whether the first and second bin door switches are closed or open. The bin door switches are normally closed during the freezing cycle, and open when the probe or harvest initiate to allow the harvested ice to enter the bin.

First and second cam sensors 150 and 152 are connected, respectively, to pins 5 and 6 of the controller sensor connectors 144. When the cam switches 98 and 99 go from the normally closed position to the normally open position, they reset the time to allow the machine to go back into another freeze cycle; this occurs after the harvest probe assist motors 94 and 95 have made a complete rotation. If the ice level in the storage bin is high enough to hold a splash curtain forward, its bin control switch opens.

During the time the evaporator rack contains ice, the curtain switches cannot open to shut off the system, but must wait until after the existing ice slab is harvested. Ice and wash selector switch sensing circuits 154 and 156 are connected, respectively, to pins 7 and 8 of the controller sensor connectors 144. This switch initializes the controller 122 for ice making or washing out the water system. When the ice output becomes mushy or no ice is produced, even though the water system is purged, washing the water system may be in order. Washing is accomplished by adding a suitable solvent to the water in the water tank and activating the water system motor to pump the cleaning water through the system. The ice making routine will be described in detail hereinafter.

A ground 158 is connected to pin 9 of the controller sensor connectors 144 to meet building code, and U.L. requirements. A purge selector switch sensing circuit 160 is connected to pin 10 of the controller sensor connectors 144. The purge switch 80, which is normally open, closes during defrost. The controller sensing the closed purge switch opens the water purge valve to allow the water pump to purge the water from the water tank; the impurities and sediment are removed with the water from the tank.

Finally, condenser and evaporator thermistor sensing circuits 162 and 164 are connected to pins 11 and 12 of the controller sensor connectors. The controller 122 continuously monitors the condenser and evaporator thermistors 71 and 33 for condenser and evaporator temperatures for display on the display 142.

The controller 122 controls power application to the system electrical components through a plurality of power connector circuits 166. Except for pin 11, described hereinafter, the controller 122 power pins are connected as follows: pins 1 and 6 through leads 168 and 170 to the power source 172 for controlling the connection of power machine elements including; pin 7 through lead 174 to the condenser water control solenoid 72, if water cooled, or to the two condenser fan motors 66 and 68, if air cooled for controlling the condenser temperature during freezing, harvest anticipation and harvest; pin 8 through lead 176 to the hot gas valve solenoid 50 for controlling the flow of hot gas to the condenser during freezing and evaporator during harvest; pin 9 through lead 178 to the water pump 102 for controlling pump action; pin 10 through lead 180 to the water valve solenoid 80 for controlling the flow of water to the evaporator during freezing and to the drain pipe during freezing; and pins 12 and 13 through leads 182 and 184 to the harvest (probe motors) 94 and 95 for harvesting the ice cubes. The controller also controls the operation lights and the digital readout (display).

The condenser fan motors or condenser water valve solenoid, whichever is used, the hot gas solenoid, water pump solenoid, purge solenoid and the two harvest motors are connected through lead 188 to the power source terminals 172 to complete the sensor circuits. Compressor control is provided through pin 11 of the power connectors 166. Pin 11 is connected through lead 190 to the high pressure control switch 106. The high pressure control switch is connected by lead 192 to the coil 194 of contactor 124 to control compressor operation. The coil of the contactor is connected to a terminal of power source terminals 172 for receiving operating power. The power source terminal is also connected to terminal 5 of potential relay 78 (potentiometer) for power control; terminal 5 is also connected to the C (compressor relay) terminal of compressor 44 for controlling power to the compressor.

Returning to the contactor coil 194, the conductor coil is inductively connected to switch 198 of the contactor. One terminal of the switch is connected to a terminal of the power source 172; the other terminal of the switch is connected to a first plate of run capacitor 200 for charging. The second plate of run capacitor 200 is connected to the 2 terminal of the potential relay 78 for producing a starting capacitor charging voltage. The 1 terminal of potential relay 78 is connected to a first plate of a starting capacitor 202 for charging; the second plate of the starting capacitor is connected to the first plate of running capacitor 200. The second plate of the run capacitor 200 is connected to the S (start) terminal of the compressor 44; while, the first plate is connected to the R (run) terminal.

In operation, the contactor coil, when energized closes the power switch to provide power to the compressor. The start capacitor supplies additional power for start up and the run capacitor provides voltage fluctuation adjustment for the running power. The potentiometer provides the correct charging power to the capacitors and to the compressor.

DISPLAY

The display 142, which is, for example, a liquid crystal display having one or more digits, is connected to the programmable controller for continuously displaying the evaporator and condenser temperatures. The temperature display may be interrupted to sequentially display the timing functions, seven coded diagnostic errors, and the total number of harvests. If a one digit display is used any movement of the potentiometer after setting will cause the display to show a number between 1 and 9. This number times 10 indicates the harvest anticipation time. The evaporator and condenser temperatures are displayed on a one digit display as follows:

For the evaporator temperature an "E" is displayed for ½ second indicating an evaporator temperature will follow. The display then goes blank for ¼ second. Then the first, second and third temperature numbers sequentially flash on for ½ second at ¼ second off (blank) intervals.

Next a "C" is displayed for ½ second indicating a condenser temperature will follow. The display then goes blank for ¼ second. Then the temperature digits are sequentially displayed as above described for the evaporator temperature.

The display then goes blank for 1 second to signal the end of the temperature cycle before repeating the cycle.

The evaporator and condenser temperatures are alternately displayed continuously until interrupted for the display of time, error codes, and accumulated number of error and harvest occurrences.

PROGRAM FLOWCHARTS

The cycle begins by checking the status of the "ice/wash" selector switch. If the switch is off all controlled devices are off until the switch is moved to either wash or ice selection position.

When the ice/wash selector switch is in the wash position; all controlled devices are off except for the water pump which is on. The purge solenoid can be opened to drain water by depressing and holding the purge switch. After wash is completed, the switch is returned to either the off or ice position.

When the ice/wash selector switch is in the ice position, the bin full switches are tested. If either or both bin full switches indicate a full bin, all controlled devices remain off except for the bin full light which is activated. When the bin full lights go off, the unit starts the ice making cycle and stays in cycle until the bin fills up again or the ice/wash selector switch is moved either to the off or wash position.

FIGS. *7a* and *7b* are flowcharts of the ice maker operation of the invention.

At start 300 (FIG. *7a*), the controller is initialized by moving the Ice/Off/Wash switch from the Off position, and a command 302 is issued to determine if the machine contains one or two evaporators, the suction line safety control contacts are closed, the bin control circuits are closed, and whether the ice selection is made.

When the machine is powered up for the first time or upon a reset or memory loss condition, a determination must be made whether the machine has one or two evaporators. The controller determines this by entering the harvest mode without the bin control cycle. Thus, the hot gas valve, harvest motors, compressor and the harvest light are powered on. If cam 2 does not detect a probe movement within two minutes, the controller decides it has only one evaporator and stops the cycle when the probe is in the retracted position.

Decisions 304 and 306 are then made whether the suction line safety control contacts and the bin control circuits are closed; if the decision is no, the operation is stopped, if yes, then a decision 308 is made whether the ice selection has been made. If the decision is no, an instruction 310 is issued to power on the water control valve control for washing the water system; if yes, an instruction 312 is issued to call in the ice making routine. The ice routine continues to repeat until the selection switch is turned to the Off position at which time exit is made.

The ice making routine (FIG. 7*b*) at start 314 issues an instruction 316 to energize: power connector (relay) number 3 to power the compressor; power connector (relay) number 5 to power the water pump; and power connector (relay) number 7 to power the condenser cooling means, fans or water coils, for the first freeze cycle. During the first freeze cycle the low pressure control contacts are open; while, the timer, and lock in relay purge valve, and probe assist motors are de-energized. The cam switch is in the normally closed position. The controller continuously monitors the condenser and evaporator temperatures through sensor connectors 11 and 12 and modifies the system operation accordingly. During this time, ice continuously is being formed on the evaporator plates, the refrigeration load becomes less and less, the suction pressure keeps reducing until the pressure reaches the low pressure control setting, and the evaporator temperatures are falling.

Then a decision 318 is made whether the evaporator temperatures have reached 14 degrees Fahrenheit. If the decision is no, return is made to instruction 316. If this temperature is not reached within 50 minutes or if 40 degrees Fahrenheit is not reached within 6 minutes, a "time out" error will be logged, the error code 1 will be displayed on the display and the service light is activated. All other controlled devices will be turned off until reset by a serviceman. If decision 318 is yes, an instruction 320 is issued to start the bridge forming timer, and to create by-pass circuits around the bin control. During this time the compressor, water pump, and fans are still energized and the ice is building the ⅛ inch bridge across the ice cubes in the evaporator racks. This constitutes the timed or second freeze cycle.

Next, a decision 322 is made whether the time of the step 2 freezing cycle has run out. If the decision is no, return is made to instruction 320; if yes, an instruction 324 is issued to initiate the timer for the harvest anticipation cycle, open the power connector (relay) number 7 to shut down the condenser fans and at a certain temperature to open and close relay number 7 to maintain the temperature between a temperature range.

The harvest anticipation feature causes the head pressure to increase. The head increase will speed up the harvest and minimize slab melting. The harvest anticipation feature continues for a preselected time between 0 to 90 seconds. The time is set by a potentiometer. During this time, the condenser fans or condenser water, if water cooled, is shut down until the condenser temperature exceeds about 114 degrees Fahrenheit and then cycled on and off to maintain this temperature between 114 degrees Fahrenheit and 117 degrees Fahrenheit. By increasing the condenser temperature the hot gas temperature is increased to expedite the defrost during harvest.

Next, an instruction 326 is issued to close power connector (relay) number 4 to energize the solenoid operated water valve to perform the purge (If purge setting is 0).

Next, an instruction 327 is issued to close power connector (relay) number 2 to start the first harvest (probe 1) motor, to close power connector (relay) number 6 to energize the hot gas solenoid, and to close power connector (relay) number 1 to start the harvest motor 2, and to open the bin doors if used. A second pass is made around the bin control for continuing the finishing of the cycle should the bin control open before the harvest cycle has completely ended. With the hot gas solenoid energized, hot gas begins to flow from the compressor to the evaporator. The opening and closing of the bin door operating switches or bin control switches are monitored by energizing sensor connectors 1, 3 and 1, 4, respectively.

If a purge is not to be made for each freezing cycle, then at the beginning of each defrost cycle, the purge counter decrements by one the selected number of cycles for each purge (0 to 9). When the counter decrements to 0, the instructions 326 includes closing power connector (relay) number 4 to energize the purge valve solenoid to open the water tank valve to pump the water tank dry. The purge cycle for a two evaporator machine continues for 20 seconds as opposed to 12 seconds for a single evaporator machine.

Next, a decision 328 is made whether the temperature has risen above 14 degrees Fahrenheit. If the decision is no, the defrost cycle is continued; if yes, an instruction 330 is issued to de-energize the timing module. (Relay numbers 1 and 2 remain energized as long as the timing module is closed or cam switch number 1 is in the closed position.) Harvest motor number 2 will continue to turn until harvest motor number 1 returns its can switch to a normally closed position. The hot gas valve relay number 6 remains energized as long as either cam switch is in the normally open position.

Next, sensor connector number 5 is monitored and a decision 332 is made whether can switch number 1 has closed. If the decision is no, the harvest cycle is continued; if yes, sensor connector number 6 is monitored and a decision 344 is made whether cam switch number 2 has closed. If the decision is no, the harvest cycle is continued. If both probes do not return to the retracted position within 5 minutes after both curtains have been opened and closed again, all controlled devices are turned off, error code 2 will be displayed, and the serviceman light activated. If decision 344 is yes, the harvest has been completed and an instruction 336 is issued to de-energize power connector (relay) number 6 for the hot gas valve, close the bin doors, reset the timer, de-energize power connector (relay) number 4 to turn off the purge valve and power connector number 5 energized to energize the water pump. It will be appreciated that for the cams to be closed, the probe assist motor has overcome the capillary attraction of the ice to the evaporator freeze plate and dumped the ice into the bin.

Then the sensor connectors 1, 3 and 2, 4 are monitored and a decision 338 is made whether the bin control switches are open. If the decision is no, return is made to instruction 316. If both contains do not open within 5 minutes after harvest initiates, all controlled devices will be deactivated, error code 3 is displayed on the display and the service light is activated. If either curtain remains in the open position for more than 10 seconds, the bin is full, and the bin full light turns on and all other controlled devices are turned off. However, if the bin full condition occurs in a stacking configuration, the top machine completes its harvest. If decision 338 is yes, the decision is continued until enough ice has been removed from the bin to close the bin control switch. Exit is made when the initiation switch is returned to the off position.

COMPONENT ON TIME

FIG. 8 summarizes the On Time of the ice maker principal components. It will be noted that the compressor (relay 3) is on throughout the ice making cycle; the water pump (relay 5) is on from the beginning of the ice making cycle through the water purge; the condenser fans (relay 7) are on from the beginning of the ice making cycle through the timed freeze; the harvest motors (relays 1 and 2) are on only during the harvest; the purge valve (relay 4) is on only during the purge; and the hot gas valve (relay 6) is on only during the harvest.

The programmable controller continuously monitors the condenser temperature to actuate the fans (or condenser water) only when the condenser reaches 90 degrees Fahrenheit. If the condenser temperature falls below 75 degrees Fahrenheit, the fans or water, as appropriate, will shut down until the temperature rises to the 90 degree mark.

DIAGNOSTIC FEATURE

The controller continuously monitors the ice making machine operation and periodically samples, for example, seven operation characteristics set forth in Table 1 and stores in memory the result and time of sampling. The number of harvests is also counted. The reset button 140 (FIG. 6) is pushed to interrupt the display of the condenser and evaporator temperatures and sequentially display the seven error codes for errors that have an accumulated total count greater than zero since the last five second reset and the total number of harvests. When the reset is pressed momentarily for the test mode, an "E" will display for ½ second. The "E" will be followed by a ¼ second display blank and then a "C" will be displayed for ½ second to indicate that the error codes are to follow. The error code identification number (1 through 7) will flash on for ½ second, off for ½ second, and on again for ½ second. Then a "dash" will appear and hold for ½ second. The number of error occurrences then appears, one number at a time, and holds for ½ of a second for each digit and off for ¼ second between each digit. The error codes will count to 99 and then hold until reset. The display is off for 1 second between each error code. The controller will then go on to the next error code or the harvest count. The harvest count will follow all error codes. An "H" will display for ½ second. The "H" is followed by a dash which is displayed for ½ second following the dash the total number of harvests are displayed, one number at a time for ½ second with a ¼ second delay between digits. Then the display goes blank for one second before showing the evaporator and condenser temperaturs again. The display will recycle to 0 after, for example, each 64,999 harvests. All accumulated error codes and number of harvests are kept permanently in the controller memory unless the memory is reset to zero; this is done by holding in the reset button for a minimum of five seconds. At this point all accumulated error codes and harvests will reset to zero and the counting will start over.

The error codes, the code error interpretations, and diagnostic characteristics are set forth in the following Table.

TABLE

EC1 Freeze cycle exceeds 50 minutes, or the evaporator(s) fail to reach 40° F. in 6 minutes.
Loss of charge
Defective compressor
Dirty condenser
Blocked air flow EC2 Probe does not return within 5 minutes after both doors have opened and closed during a harvest. Machine will automatically reset after 2 hours.
Stuck probe
Defective harvest assist motor EC3 Both doors not open within 5 minutes after harvest initiate, or both probes return without doors opening. Machine will automatically reset after 2 hours.
Slab hung up
Defective hot gas valve
Defective harvest motor
Curtain switch shorted
Curtain switch open
Curtain switch alignment
No slab is made
Thin slab, probe punches hole in slab
Poor probe alignment EC4 Memory lost
Either ROM or RAM EC5 Broken sensor wire. (Note: If the selector switch is turned to the off position, the controller will specify which sensor by displaying either an "E" or a "C".
Splice wire EC6 Shorted sensor wire.
Replace sensor EC7 Condenser exceeds 140 degrees Fahrenheit. Machine will automatically reset after 2 hours.
Defective fan or water valve
Dirty condenser
Ambient temperature over 120 degrees Fahrenheit H Number of harvests.
Recycles after 64,999.

Although only a single embodiment of the invention has been described, it will be apparent to a person skilled in the art that various modifications to the details of construction shown and described may be made without departing from the scope of this invention.

What is claimed is:

1. An ice making machine comprising:

a. a compartmentalized housing;

b. a cooling means mounted in a first compartment of the housing, said cooling means including:

(1) an ice cube mold means and a refrigerating means, said ice cube mold means responsive to the refrigerating means for cooling the ice cube mold means to a freezing temperature;

(2) a water supply means operatively connected to the ice cube mold means for flowing water over the ice cube mold means, first to form ice cubes in the ice cube mold means, and secondly to form an ice bridge over the ice cube mold means for forming with the ice cubes an ice cube interconnecting slab; and (3) a harvest probe assist means in operative association with the ice cube mold means for removing the ice cube interconnecting slab;

c. a programmable controller means including sensor connecting circuits operatively connected to the refrigerating means, water supply means, and harvest probe assist means for sensing refrigerator, water supply means, and probe assist means operations, and a data processing means responsive to the outputs of the sensor connecting circuits for producing operating and diagnostic instructions, and power connector circuits operatively connected to the refrigerating means, water supply means and probe assist means responsive to the operating instructions for producing ice cubes, and a display means responsive to the diagnostic instructions for displaying coded error information for maintenance;

d. an ice receiving means mounted in a second compartment of the housing, said ice receiving means being in operative association with the cooling means for storing the ice cubes and having bin control switching means operatively connected to the programmable controller for detecting a full bin and turning the cooling means off; and e. wherein the programmable controller includes means for bypassing the bin control switch sensor connectors unit control signals to the programmable controller until completion of any ice cube harvest in process.

2. An ice making machine comprising:

a. a compartmentalized housing;

b. a cooling means mounted in a first compartment of the housing, said cooling means including:

(1) an ice cube mold means and a refrigerating means, said ice cube mold means responsive to the refrigerating means for cooling the ice cube mold means to a freezing temperature;

(2) a water supply means operatively connected to the ice cube mold means for flowing water over the ice cube mold means, first to form ice cubes in the ice cube mold means, and secondly to form an ice bridge over the ice cube mold means for forming with the ice cubes an ice cube interconnection slab; and (3) a harvest probe assist means in operatively association with the ice cube mold means for removing the ice cube interconnecting slab;

c. a programmable controller means including sensor connecting circuits operatively connected to the refrigerating means, water supply means, and harvest probe assist means for sensing refrigerator, water supply means, and probe assist means operations, and a data processing means responsive to the outputs of the sensor connecting circuits for producing operating and diagnostic instructions, and power connector circuits operatively connected to the refrigerating means, water supply means and probe assist means responsive to the operating instructions for producing ice cubes, and a display means responsive to the diagnostic instructions for displaying coded error information for maintenance; and d. wherein the refrigerating means includes an evaporator, a condenser operatively connected to the evaporator, a compressor operatively connected to the evaporator and condenser, and a hot gas valve means for selectively connecting the compressor to the condenser and to the evaporator, and cooling means operatively connected to the condenser and programmable computer said cooling means responsive to the programmable computer for selectively cooling the condenser thereby producing high pressure liquid for freezing operations and hot high pressure gases first in harvest anticipation and secondly for harvesting ice cubes.

3. An ice making machine comprising:

a. a compartmentalized housing;

b. a cooling means mounted in a first compartment of the housing, said cooling means including:

(1) an ice cube mold means and a refrigerating means, said ice cube mold means responsive to the refrigerating means for cooling the ice cube mold means to a freezing temperature;

(2) a water supply means operatively connected to the ice cube mold means for flowing water over the ice cube mold means, first to form ice cubes in the ice cube mold means, and secondly to form an ice bridge over the ice cube mold means for forming with the ice cubes an ice cube interconnecting slab; and (3) a harvest probe assist means in operative association with the ice cube mold means for removing the ice cube interconnecting slab;

c. a programmable controller means including sensor connecting circuits operatively connected to the refrigerating means, water supply means, and harvest probe assist means for sensing refrigerator, water supply means, and probe assist means operations, and a data processing means responsive to the outputs of the sensor connecting circuits for producing operating and diagnostic instructions, and power connector circuits operatively connected to the refrigerating means, water supply means and probe assist means responsive to the operating instructions for producing ice cubes, and a display means responsive to the diagnostic instructions for displaying coded error information for maintenance; and d. wherein said water supply means includes a water tank, a water tank drain, a solenoid operated valve means operatively connected to the programmable controller, and a water pump, the solenoid valve means responsive to instructions from the programmable controller for selectively pumping water from the tank to the ice cube mold means for ice making and to a water drain for purging the tank of mineral deposits after a preselected number of freezing cycles.

4. An ice making machine comprising:

a. a compartmentalized housing;

b. a cooling means mounted in a first compartment of the housing, said cooling means including:

(1) an ice cube mold means and a refrigerating means, said ice cube mold means responsive to the refrigerating means for cooling the ice cube mold means to a freezing temperature;

(2) a water supply means operatively connected to the ice cube mold means for flowing water over the ice cube mold means, first to form ice cubes in the ice cube mold means, and secondly to form an ice bridge over the ice cube mold means for forming with the ice cubes an ice cube interconnecting slab; and (3) a harvest probe assist means in operative association with the ice cube mold means for removing the ice cube interconnecting slab;

c. a programmable controller means including sensor connecting circuits operatively connected to the refrigerating means, water supply means, and harvest probe assist means for sensing refrigerator, water supply means, and probe assist means operations, and a data processing means responsive to the outputs of the sensor connecting circuits for producing operating and diagnostic instructions, and power connector circuits operatively connected to the refrigerating means, water supply means and probe assist means responsive to the operating instructions for producing ice cubes, and a display means responsive to the diagnostic instructions for displaying coded error information for maintenance; and d. wherein the programmable controller further includes an anticipation timer means for setting a preselected harvest anticipation time for preparing the ice cube mold means for ice cube harvest.

5. An ice making machine comprising:

a. a compartmentalized housing;

b. a cooling means mounted in a first compartment of the housing, said cooling means including:

(1) an ice cube mold means and a refrigerating means, said ice cube mold means responsive to the refrigerating means for cooling the ice cube mold means to a freezing temperature;

(2) a water supply means operatively connected to the ice cube mold means for flowing water over the ice cube mold means, first to form ice cubes in the ice cube mold means, and secondly to form an ice bridge over the ice cube mold means for forming with the ice cubes an ice cube interconnecting slab; and (3) a harvest probe assist means in operative association with the ice cube mold means for removing the ice cube interconnecting slab;

c. a programmable controller means including sensor connecting circuits operatively connected to the refrigerating means, water supply means, and harvest probe assist means for sensing refrigerator, water supply means, and probe assist means operations, and a data processing means responsive to the outputs of the sensor connecting circuits for producing operating and diagnostic instructions, and power connector circuits operatively connected to the refrigerating means, water supply means and probe assist means responsive to the operating instructions for producing ice cubes, and a display means responsive to the diagnostic instructions for displaying coded error information for maintenance; and d. wherein the programmable controller further includes a freeze timer means for setting an end of cycle freezing time for forming the ice cube interconnecting slab.

6. An ice making machine comprising:

a. a compartmentalized housing;

b. a cooling means mounted in a first compartment of the housing, said cooling means including:

(1) an ice cube mold means and a refrigerating means, said ice cube mold means responsive to the refrigerating means for cooling the ice cube mold means to a freezing temperature;

(2) a water supply means operatively connected to the ice cube mold means for flowing water over the ice cube mold means, first to form ice cubes in the ice cube mold means, and secondly to form an ice bridge over the ice cube mold means for forming with the ice cubes an ice cube interconnecting slab; and (3) a harvest probe assist means in operative association with the ice cube mold means for removing the ice cube interconnecting slab;

c. a programmable controller means including sensor connecting circuits operatively connected to the refrigerating means, water supply means, and harvest probe assist means for sensing refrigerator, water supply means, and probe assist means operations, and a data processing means responsive to the outputs of the sensor connecting circuits for producing operating and diagnostic instructions, and power connector circuits operatively connected to the refrigerating means, water supply means and probe assist means responsive to the operating instructions for producing ice cubes, and a display means responsive to the diagnostic instructions for displaying coded error information for maintenance; and d. wherein the programmable controller sensing circuits include sensing circuits for sensing the position of an operation selector switch, and the power connector circuits include power connector circuits for supplying power to a harvest motor, water pump motor, condenser cooling means, hot gas valve solenoid, and purge solenoid of the water supply solenoid operated valve.

7. An ice making machine comprising:

a. a compartmentalized housing;

b. a cooling means mounted in a first compartment of the housing, said cooling means including:

(1) an ice cube mold means and a refrigerating means, said ice cube mold means responsive to the refrigerating means for cooling the ice cube mold means to a freezing temperature;

(2) a water supply means operatively connected to the ice cube mold means for flowing water over the ice cube mold means, first to form ice cubes in the ice cube mold means, and secondly to form an ice bridge over the ice cube mold means for forming with the ice cubes an ice cube interconnecting slab; and (3) a harvest probe assist means in operative association with the ice cube mold means for removing the ice cube interconnecting slab;

c. a programmable controller means including sensor connecting circuits operatively connected to the refrigerating means, water supply means, and harvest probe assist means for sensing refrigerator, water supply means, and probe assist means operations, and a data processing means responsive to the outputs of the sensor connecting circuits for producing operating and diagnostic instructions, and power connector circuits operatively connected to the refrigerating means, water supply means and probe assist means responsive to the operating instructions for producing ice cubes, and a display means responsive to the diagnostic instructions for displaying coded error information for maintenance; and d. wherein the data processing means diagnostic instructions consist of coded error instructions selected from the group consisting of:

(1) freeze cycle exceeds a preselected time;

(2) probe does not return within a preselected time after doors open and close during a harvest;

(3) door not open or probes return without doors opening without a preselected time after initiating harvest;

(4) power connector not active;

(5) sensor wire broken;

(6) sensor wire shorted; and (7) condenser temperature exceeds a preselected high temperature setting.

8. An ice making machine comprising:

a condenser and a condenser cooling means coacting for producing a high pressure liquid, and expansion means connected to the condenser for expanding the high pressure liquid into a low pressure liquid, an evaporator means connected to the expansion means for receiving the low pressure liquid for absorbing heat from the evaporator to boil and evaporate the low pressure liquid for producing a low pressure gas and reducing the temperature of the evaporator means to a preselected temperature, a compressor connected to the evaporator for compressing the low pressure gas to a high pressure gas, and a conduit means including a first conduit connecting the compressor to the condenser and a second conduit connecting the condenser and compressor to the evaporator, and a valve means in the second conduit for controlling the flow of high pressure gas through the first and second conduits; and a control means connected to the evaporator means, condenser cooling means, and valve means, said control means including a means responsive to the preselected cooling temperature of the evaporator for turning off the condenser cooling means to allow the condenser temperature to rise to a preselected temperature and on/off thereafter for a preselected time to maintain substantially the preselected high temperature for producing hot gas under high pressure in the condenser, and means connected to the valve means for opening the valve allowing the hot gas under high pressure to surge from the condenser into the evaporator and after the initial surge allowing hot gas to flow to the evaporator via the compressor during an ice harvest cycle.

9. An ice making machine comprising:

a refrigerating means including a condenser cooling means, a condenser in operative association with the cooling means and connected to an evaporator for passing a liquid under sufficient pressure through the evaporator to evaporate the liquid to a gas through heat absorption for cooling the evaporator to a preselected temperature for freezing ice, a compressor connected to the evaporator for increasing the pressure of the gas, a first conduit connecting the compressor to the condenser, a second conduit connected to the first conduit for connecting the condenser and compressor to the evaporator, and a valve means mounted in the second conduit for controlling gas flow therebetween; and a control means including means responsive to the preselected temperature of the evaporator for turning off the condenser cooling means to increase the condenser temperature to a preselected temperature and thereafter cycling the condenser cooling means on and off to maintain substantially the preselected temperature for increasing the temperature and pressure of the gas in the condenser in harvest anticipation; and means for opening the valve to begin a harvest cycle by allowing the condenser's hot gas under high pressure to surge through the evaporator to heat the evaporator and after the initial surge to allow hot gas to flow from the compressor through the evaporator for continued heating of the evaporator during the harvest cycle whereby a faster harvest is provided by anticipating the end of the freezing cycle and preventing damage to the machine by controlling the condenser's rise in temperature.

* * * * *